United States Patent [19]

Venker

[11] 3,969,998

[45] July 20, 1976

[54] PRINTING ACTUATOR

[75] Inventor: Hilrich Jan Matthijs Venker, Heemstede, Netherlands

[73] Assignee: Compagnie Honeywell Bull (Societe Anonyme), Paris, France

[22] Filed: Mar. 3, 1975

[21] Appl. No.: 554,626

Related U.S. Application Data

[63] Continuation of Ser. No. 479,416, June 14, 1974, abandoned, which is a continuation of Ser. No. 308,876, Nov. 22, 1972, abandoned.

[30] Foreign Application Priority Data

Nov. 30, 1971 France ..... 71.42939

[52] U.S. Cl. ..... 101/93.48; 335/229; 310/103

[51] Int. Cl.[2] ..... B41J 9/02

[58] Field of Search ..... 101/93.29, 93.3, 93.34, 101/93.48; 310/268, 103; 335/229

[56] References Cited

UNITED STATES PATENTS

| | | | |
|---|---|---|---|
| 2,183,404 | 12/1939 | Morrill | 310/103 X |
| 2,790,095 | 4/1957 | Peek et al. | 310/103 |
| 3,164,085 | 1/1965 | Hawkins | 101/93.33 |
| 3,183,385 | 5/1965 | Gabriel | 310/103 |
| 3,351,006 | 11/1967 | Belson | 101/93.02 |
| 3,477,365 | 11/1969 | Nyman | 101/93.13 |
| 3,568,593 | 3/1971 | Papndopoulos | 101/93.34 |

*Primary Examiner*—Edgar S. Burr
*Assistant Examiner*—Edward M. Coven
*Attorney, Agent, or Firm*—Diller, Brown, Ramik & Wight

[57] ABSTRACT

A printing actuator is provided comprising a plurality of hammers and a permanent rotating shaft capable of actuating each of said hammers for striking. The printing actuator is characterized on one hand, in that each hammer is arranged for rotating round an axis and is integral with electromagnetic means including two poles opposite one another and, on the other hand, in that said shaft bears a plurality of transverse parallel discs made of a conductive material, the two poles being associated with a hammer and arranged on both sides of one of said discs.

13 Claims, 4 Drawing Figures

PRINTING ACTUATOR

This is a continuation of application Ser. No. 479,416 filed June 14, 1974 now abandoned, which is a continuation of Ser. No. 308,876 filed Nov. 22, 1972 now abandoned.

BACKGROUND OF THE INVENTION

The present invention is concerned with a striking device for a printing machine of a completely new type whose printing speed may be substantially increased.

SUMMARY OF THE INVENTION

According to the invention, the striking device for a printer comprises a number of hammers and a shaft rotating continuously and capable of actuating each of these hammers causing it to perform a strike. It is distinct, on the one hand, by each of the hammers being mounted so as to pivot around an axle and by being integrated with electro-magnetic means including two poles opposite each other, and on the other hand, by said shaft bearing a number of transverse parallel discs of a material that is a good conductor of electricity. The two poles are associated with a hammer and are positioned on either side of said discs. Thus, when said electro-magnetic means associated with a hammer are actuated, a magnetic field is generated between the corresponding poles. This magnetic field entails the appearance of eddy currents in the disc positioned between said poles. The currents cause said hammer to pivot in such a manner that the poles rotate instantly along with the disc. Thus a print is performed by this hammer.

The electro-magnetic means comprise preferably a coil, concentric with the pivoting axis of the hammer, and two magnetic arms, opposite said hammer relative to said axis. The arms bear said poles at their ends. This coil may be integral with the hammer and the arms, but it is recommended that the coil be solidly attached so that the inertia of this rotating assembly be reduced, and that it may pivot relative to the coil.

The return media of the hammers may consist of media similar to the above described actuating devices or of electro-magnets. It is, at any rate, preferable for reasons of simplification that these return media consist of springs.

When this printing device includes a number of aligned hammers it may be useful, so as to give them appropriate dimensions, to divide them into two groups in such a way that two adjoining hammers belong to different groups and to provide two parallel pivoting axes, associated with one of said groups, each disc of the shaft being associated with one hammer of one of the groups, and with a hammer of the other group.

BRIEF DESCRIPTION OF THE DRAWING

The figures of the attached drawing will clarify the embodiment of the invention, in which.

DESCRIPTION OF THE PREFERRED EMBODIMENT

Figure 1:
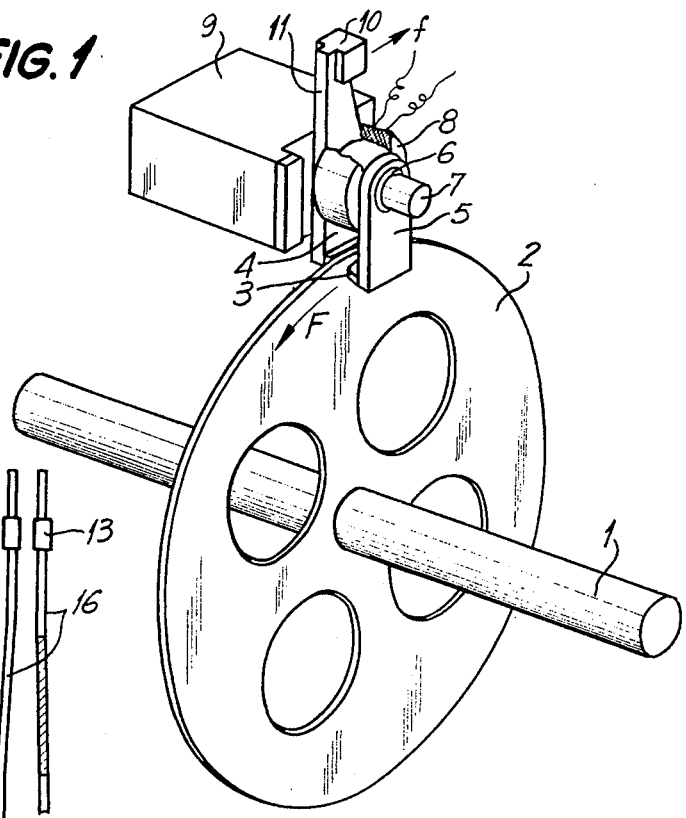
FIG. 1 is a perspective view designed to explain the operation of the printing hammer according to the invention.

The printing module shown in FIG. 1 comprises a shaft 1, constantly rotating in the direction of the arrow F, on which is mounted a disc 2 of a material which is a good conductor of electricity, such as copper or aluminum. The periphery of the disc 2 is engaged between the poles 3 of an electromagnetic circuit comprising a U-formed frame, consisting of two parallel arms 4 and 5, solidly attached to each other, at their ends opposite poles 3 by a socket 6 which is concentric with a non-magnetic shaft 7 round which the assembly 3, 4, 5, and 6 may rotate. The electro-magnetic coil 8 is positioned between the arms 4 and 5 and concentrically with the socket 6 and is attached from the outside in a manner not shown to the frame 9 of the machine of which the print module is a part, but in such a fashion that it does not share in the rotation of the assembly 3, 4, 5, and 6. A print hammer 10 is solidly attached to the free end of an arm 11 which is an extension of the arm 4 beyond the axis of non-magnetic shaft 7.

When the coil 8 is excited by a pulse a magnetic field occurs between the poles 3 and 3' of the arms 4 and 5 and crosses the rotating disc 2. Its result is the formation of eddy currents in this disc which currents effect the driving of the arms 4 and 5 in the direction F of the rotation of the disc 2, and, consequently, the driving of the hammer 10 in the direction f of the strike.

The return of the hammer 10 to the rest position as illustrated in FIG. 1, at the end of the excitation pulse of the coil 8, may be accomplished by a device similar to the actuating device which was just described, but driving the hammer 10 in the reverse direction. Such a device offers the advantage of preventing rebounds of the hammer and of reducing the total time for a cycle of the hammer. Yet for purposes of simplification it is preferable to use a return spring (not shown in FIG. 1).

It goes without saying that the shaft 1 is capable of carrying a number of discs 2 whereas a number of hammers 10 may pivot round the shaft 7, whose arms 4 and 5 interact with one of the discs 2. In this manner a striking device is obtained which may be applied to a printer of the parallel or parallel-series type.

Figure 4:
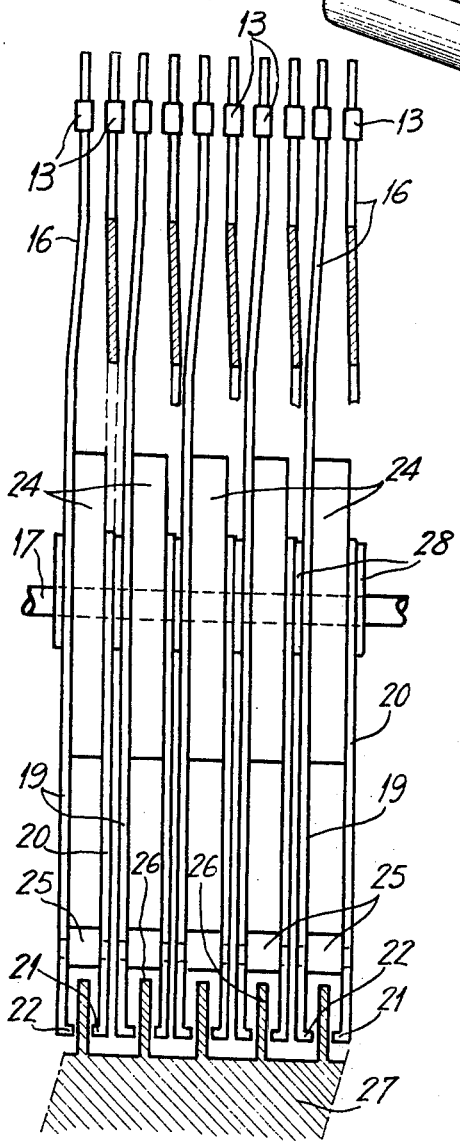
FIG. 4 is an enlarged section taken along the line IV—IV of FIG. 2.
Figure 2:
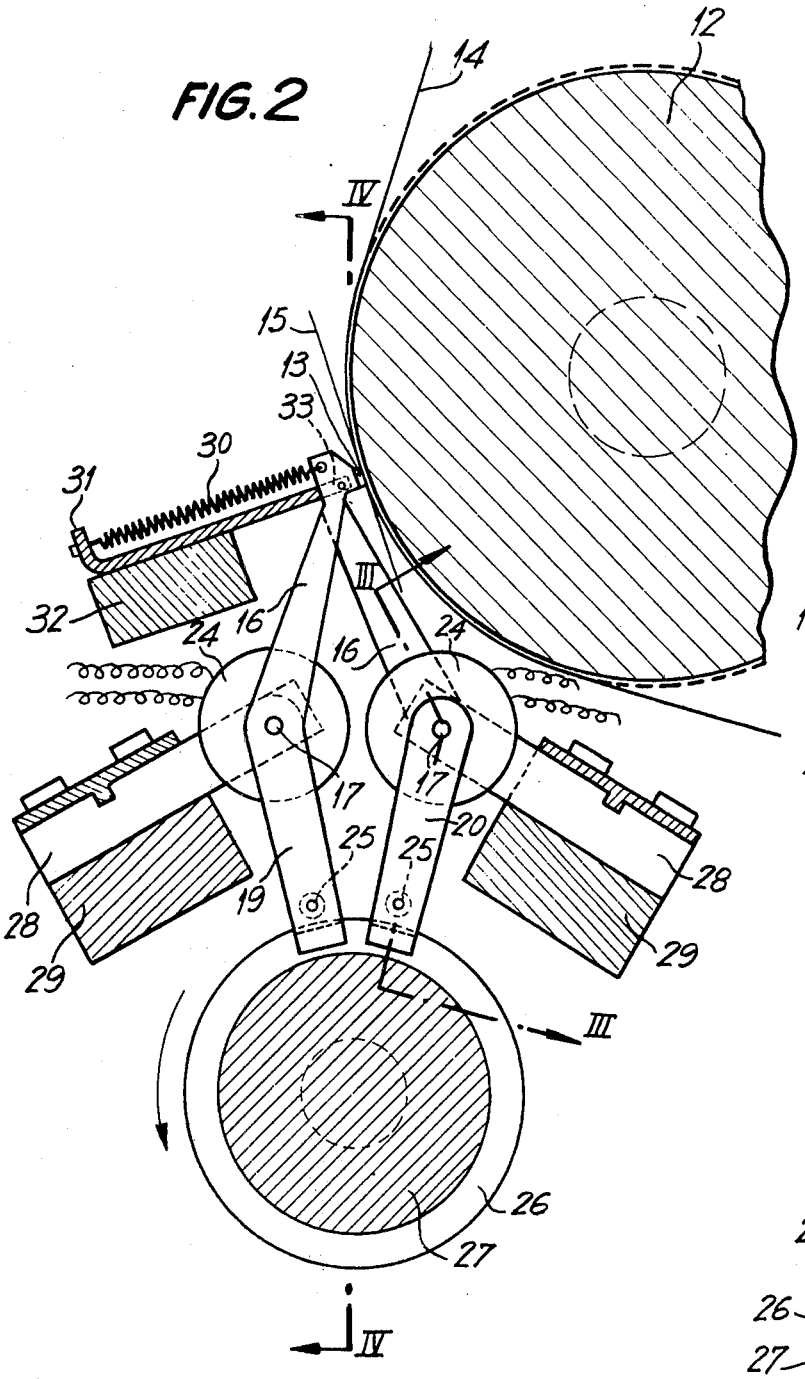
FIG. 2 is an elevational view, partially in section, of a striking device for a printer according to the invention.
Figure 3:
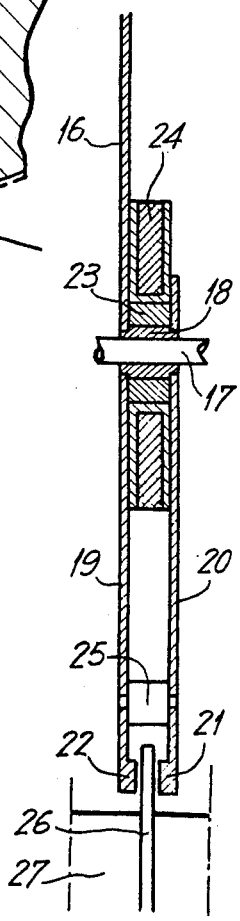
FIG. 3 is an enlarged section taken along the line III—III of FIG. 2.

FIGS. 2 to 4 show a striking device for a parallel printer fo the "back striking" type in which the characters are carried by a character-bearing drum 12, which is continuously in rotation. Opposite a surface of the drum 12 a number of aligned striking hammers 13 is arranged. A paper tape 14 and a carbon ribbon 15 pass between said striking hammers 13 and the drum 12.

This striking hammer 13 is integral with the end of an arm 16 which is mounted so as to rotate on a fixed shaft 17 by means of a ring 18 of non-magnetic and wear resistant material, for instance of self-lubricating calcinated bronze, Nylon or Delrin.

Each arm 16 extends beyond the axis 17 by an arm 19. An arm 20, identical with arm 19, is connected with the latter so as to be capable of rotating with the ring 18, its free end 21 being positioned opposite the free end 22 of the arm 19. These two arms are made of a magnetic material. They are joined on the side of shaft 17 by a magnetic core 23 which surrounds the ring 18. An electro-magnetic coil 24 is mounted on the magnetic core 23 between the arms 19 and 20. Thus, these arms constitute together with coil 24 and the core 23 an electro-magnetic circuit whose poles are the ends 21 and 22.

Laterally of these poles the two associated arms 19 and 20 are kept spaced from one another by a non-magnetic brace 25. Such a brace prevents the displacement of the two poles 21 and 22 toward each other by mutual attraction during the excitation of the coil 24.

In the air-gap of each pair of poles 21 and 22 the periphery of a copper disc 26 is located. All the discs 26 are parallel to each other and solidly attached to a drum 27 which is continuously driven at high speed. The discs 26 are transverse to the axis of the drum 27.

There are half as many discs 26 as hammers 13, while the latter are mounted rotating round two parallel shafts 17 in such a way that two adjoining hammers rotate, one around one of said shafts 17 and the other round the other shaft. Thus a single disc 26 may drive two hammers 13. Such an arrangement has advantages for it permits one to provide satisfactory dimensioning of the strike modules. The result is that the arms 16 of the two hammers 13 adjacent to each other are curved towards one another in such a manner that the distance separating these two adjoining hammers corresponds with a pitch of the characters on the drum 12.

The two shafts 17 are supported by the arms 28, integral with beams 29, positioned longitudinally relative to the drum 27. The arms 28 are of a non-magnetic material and function simultaneously as separators between the striking modules.

There is also a resistant support needed for the striking modules 17 because of the considerable forces acting on these shafts at the moment of impact and for support of the weight of the modules which may produce a deformation by bending of said shafts.

The excitation of a coil 24 generates a magnetic field in the air-gap of the corresponding poles 21 and 22. This magnetic field crosses the disc 26 positioned in this air-gap and generates eddy currents there which causes the arm 16 to pivot for the strike of the hammer which it carries.

Each hammer 13 is maintained in its rest position by a spring 30, operating as return device for said hammer after a strike. The springs 30 are mounted between the corresponding arms 16 and a leg of the angle iron 31, mounted on a longitudinal beam 32. The angle iron 31 is equipped with slots 33 placed opposite of the character columns on the drum 12 and function as guides for the ends of the arms 16 during the striking of the hammers 13.

The springs 30 may be replaced by electro-magnets each of which would be linked with a striking hammer and would be continuously excited up to the moment at which the corresponding coil would receive a strike pulse.

The electro-magnet would then again be excited. Thus, compared to the springs 30, the electro-magnets would offer the advantage that no retention force would be applied to the hammers during the strike, hence the striking speed would be greater.

As already mentioned above, the return of the hammers could also be effected by a device operating by the generation of Foucault currents and of a type similar to the one described in the actuating of said hammers.

What is claimed is:

1. A striking device for a printing machine comprising, in combination:

an axle defining a pivot axis;

a plurality of hammers pivotally mounted on said axle;

a continuously rotating shaft disposed in spaced parallel relation to said axle;

electromagnetic means associated with each individual hammer for selectively causing said individual hammer to pivot on said axle to perform a strike, each said electromagnetic means including a magnetic frame defining a closed magnetic circuit having an air gap and formed in part by a pair of magnetic arms rotatable around said pivot axis and connected to said individual hammer, said pair of magnetic arms extending from said axle toward said shaft and having free end portions presenting spaced poles defining said air gap, means for selectively creating a magnetic flux field between said free end portions across said air gap, and a disc of non-magnetic, electrically conductive material fixed to said continuously rotating shaft so as to rotate continuously therewith, said disc having opposite side faces, said arms straddling said disc to position said disc within said air gap whereby, when said magnetic flux field is created between said free end portions across said air gap, said flux field causes currents to flow in said disc, which currents act forcibly on said pair of magnetic arms to move said hammer.

2. A striking device according to claim 1 characterized in that said means for selectively creating a magnetic flux field includes a coil carried on said axle and concentric with the pivot axis of the hammer.

3. A striking device according to claim 1, wherein said plurality of hammers forms a first group, said striking device comprising at least one additional axle, each additional axle defining an additional pivot axis parallel to said axle, and a further plurality of aligned hammers divided into a number of further groups in such a manner that no two adjoining hammers are in the same group said hammers within each given one of said further groups being pivotably mounted on a different one of said axles, each disc of the shaft being associated with at least two hammers from different groups.

4. A striking device as defined in claim 1 including return means connected to each hammer for positioning it normally in predetermined position.

5. A striking device as defined in claim 1 wherein said means for selectively creating a magnetic flux field between said free end portions across said air gap comprises an annular coil surrounding said axle between said magnetic arms and relative to which said pair of magnetic arms are movable whereby said annular coil contributes nothing to the inertia of said individual hammer.

6. In a printing machine, in combination:

a printing hammer and means mounting said hammer to allow movement thereof between a rest position and a strike position;

actuator means for selectively moving said hammer from its rest position to its strike position; and return means for returning said hammer from its strike position to its rest position;

said actuator means comprising a generally U-shaped magnetic frame connected to said hammer, said frame comprising a pair of spaced arms joined at one end by a core piece to present a closed magnetic circuit having an air gap, means for selectively energizing said circuit to produce a flux field across said gap, a disc of non-magnetic, electrically conductive material having opposite side faces, said arms straddling said disc to position said disc within said gap, and means for continuously rotating said disc whereby, when said circuit is selectively energized, said flux field causes currents to flow in said disc, which currents act forcibly on said frame to move said hammer from its rest to its striking position.

7. In a printing machine as defined in claim 6 wherein said means mounting the hammer comprises a shaft perpendicular to said arms and passing through said core piece.

8. In a printing machine as defined in claim 7 wherein said means for selectively energizing said circuit comprises a coil surrounding said core piece.

9. In a printing machine as defined in claim 8 wherein said return means includes a stationary holding means and a spring connected between said stationary holding means and said hammer, said spring and stationary holding means acting, in the absence of said flux field, to return said hammer to its rest position.

10. In a high speed printing machine, the combination of:

a plurality of hammer assemblies and a fixed shaft pivotally mounting the hammer assemblies for oscillation about a common axis; each hammer assembly comprising a first strap-like member pivotally mounted between its ends on said shaft to lie in a plane perpendicular to said shaft and to present first and second arm portions extending radially from said shaft, a second strap-like member pivotally mounted at one end thereof on said shaft to lie in a plane perpendicular to said shaft and to present a third arm extending radially from said shaft, said strap-like members being of magnetic material, a hammer at the end of said first arm, an annular magnetic core surrounding said shaft between and magnetically joining said strap-like members and the free ends of said second and third arms presenting mutually inwardly directed poles defining an air gap whereby said second and third arms together with said core piece define a U-shaped magnetic frame;

a continuously rotating second shaft disposed parallel to the shaft first mentioned and a plurality of non-magnetic, electrically conductive discs mounted on said second shaft and rotating therewith, said discs having peripheral portions disposed within said air gaps of said hammer assemblies;

a continuously moving type font assembly adjacent the hammers of said hammer assemblies;

means for normally positioning said hammer assemblies such that the hammers thereof are spaced from said type font assembly; and means for selectively energizing each U-shaped frame to produce a magnetic flux field between its poles across the associated air gap whereby said magnetic flux field causes current to flow in said discs, which current acts forcibly on each corresponding hammer assembly to cause the corresponding hammer assembly to strike the type font assembly.

11. In a high speed printing machine as defined in claim 10 wherein the means last mentioned comprises an annular coil surrounding each core piece and relative to which said core piece and associated arms are movable whereby said coil contributes nothing to the inertia of the associated hammer assembly.

12. In a high speed printing machine as defined in claim 11 wherein said means for normally positioning said hammer assemblies comprises a stationary holding means and a plurality of return springs one attached between each hammer assembly and said holding means, said springs acting with said stationary holding means, in the absence of said flux field, to position said hammer normally spaced from said type font assembly.

13. In a high speed printing machine as defined in claim 10 wherein said means for normally positioning said hammer assemblies comprises stationary holding means and a plurality of return springs one attached between each hammer assembly and said stationary holding means, said springs acting with said stationary holding means, in the absence of said flux field, to position said hammer normally spaced from said type font assembly.

* * * * *